US007967971B2

(12) United States Patent
Davison et al.

(10) Patent No.: US 7,967,971 B2
(45) Date of Patent: Jun. 28, 2011

(54) DISCRETE SACRIFICIAL ANODE ASSEMBLY

(76) Inventors: Nigel Davison, Coton-in-the elms (GB); Adrian Charles Roberts, Chilwell (GB); Gareth Kevin Glass, Lichfield (GB)

( * ) Notice: Subject to any disclaimer, the term of this patent is extended or adjusted under 35 U.S.C. 154(b) by 484 days.

(21) Appl. No.: 12/046,310

(22) Filed: Mar. 11, 2008

(65) Prior Publication Data

US 2009/0229994 A1 Sep. 17, 2009

(51) Int. Cl.
*C23F 13/18* (2006.01)
*C23F 13/06* (2006.01)

(52) U.S. Cl. ..... 205/734; 204/196.36; 204/196.18

(58) Field of Classification Search ..... 204/196.36, 204/196.37, 196.18; 205/734
See application file for complete search history.

(56) References Cited

U.S. PATENT DOCUMENTS

| | | | | |
|---|---|---|---|---|
| 4,255,241 | A * | 3/1981 | Kroon et al. | 205/734 |
| 4,812,212 | A * | 3/1989 | Dimond et al. | 205/734 |
| 5,292,411 | A | 3/1994 | Bartholomew et al. | |
| 5,650,060 | A * | 7/1997 | Huang et al. | 205/730 |
| 6,303,017 | B1 | 10/2001 | Page et al. | |
| 6,376,102 | B1 | 4/2002 | Spriestersbach et al. | |
| 6,562,229 | B1 * | 5/2003 | Burgher et al. | 205/724 |
| 6,838,525 | B2 | 1/2005 | Pitchumani et al. | |
| 7,731,875 | B2 * | 6/2010 | Glass et al. | 264/36.18 |
| 2004/0011669 | A1 | 1/2004 | Glass et al. | |
| 2007/0048533 | A1 | 3/2007 | Spriestersbach et al. | |
| 2010/0314262 | A1 * | 12/2010 | Glass et al. | 205/734 |

FOREIGN PATENT DOCUMENTS

| | | |
|---|---|---|
| GB | 2253414 | 9/1992 |
| GB | 2426008 | 11/2006 |
| JP | 4116184 | 4/1992 |
| JP | 2008169462 | 7/2008 |
| WO | WO 01/40547 | 6/2001 |
| WO | WO 2007/039768 | 4/2007 |
| WO | WO2007/101325 | 9/2007 |

OTHER PUBLICATIONS

ACI Committee E 706, Installation of Embedded Galvanic Anodes, ACI Repair Application Procedure 8, American Concrete Institute 2005.
BS EN 12696 :2000, British Standards Institute, 2000.
Electrochemical Rehabilitation Methods for Reinforced Concrete Structures, European Federation of Corrosion Publication 24 (1998) p. 1, J Mietz (Ed.).
BAC product data on MMO tape anode.

* cited by examiner

*Primary Examiner* — Bruce F Bell

(57) ABSTRACT

Sacrificial anode assemblies have the advantage that they can provide galvanic protection to steel in concrete and do not require long term maintenance of a DC power supply. However sacrificial anode assemblies often loose adhesion to the concrete surface. This invention discloses the use of a sacrificial anode (4) and a backfill (3) and a tape (5) and an adhesive to protect steel (8) in concrete. The backfill is preferably placed in a shallow cavity (1) in the concrete surface (2) and the sacrificial anode is inserted into the backfill. The cavity is covered with a tape that extends over the adjacent concrete surfaces on opposite sides of the sacrificial anode and backfill and the tape is attached to the concrete surface with the adhesive. The tape and the adhesive holds the anode in place and prevents a weathering environment from damaging the backfill.

10 Claims, 1 Drawing Sheet

DISCRETE SACRIFICIAL ANODE ASSEMBLY

TECHNICAL FIELD

This invention is related to the protection of steel in concrete construction using sacrificial anodes and in particular to the use of elongated discrete sacrificial anodes distributed across a concrete structure or embedded within shallow slots in the concrete cover to the reinforcing steel.

BACKGROUND

Corrosion of steel in reinforced concrete is a major problem. Both impressed current and galvanic (sacrificial) electrochemical treatments have been used to arrest this problem. In impressed current electrochemical treatment, the anode is connected to the positive terminal and the steel is connected to the negative terminal of a source of DC power. In galvanic electrochemical treatment, the protection current is provided by corroding sacrificial anodes that are directly connected to the steel. A sacrificial anode dissolves in the process of producing the protection current.

Sacrificial anodes for concrete structures may be divided into anodes that are embedded within cavities in the concrete (ACI Repair Application Procedure 8—Installation of Embedded Galvanic Anodes (www.concrete.org/general/RAP-8.pdf)) or anodes that are attached to the concrete surface (U.S. Pat. No. 5,292,411, BS EN 12696:2000) such that they are accessible. Sacrificial anode systems include an anode and a supporting electrolyte.

Sacrificial anodes attached directly to the concrete surface are accessible to facilitate anode replacement. However surface applied anodes often loose adhesion to the concrete surface. Sacrificial anodes are also buried in cavities formed for this purpose. These anodes are strongly attached to the concrete. However they have a small surface area and usually require some form of activation to maintain a high current output. An activating agent may be located in a porous surrounding material or backfill to promote current output. This backfill also provides space to accommodate the products of anodic dissolution. The backfill is weak and is normally separated from a weathering environment by a layer of repair mortar that will typically be 10 mm thick. This results in the need for a relatively deep cavity compared to the anode size in which to install the anode. However the size of the cavity is often limited by the location of the steel reinforcement within the concrete and it is sometimes impractical to install embedded anodes that are distributed within a concrete structure to distribute the protection current to the steel.

The problem to be solved by this invention is to improve the method of attaching sacrificial anode systems to the concrete and to reduce the amount of concrete removed when installing distributed discrete sacrificial anode systems.

SUMMARY OF THE INVENTION

This invention discloses the use of a sacrificial anode and a backfill and a tape and an adhesive to protect steel in concrete. The backfill is preferably placed in a shallow cavity in the concrete surface and the sacrificial anode is inserted into the backfill. In this preferred arrangement, the cavity is covered with a tape that extends over the adjacent concrete surfaces on opposite sides of the cavity and the tape is attached to the concrete surface with the adhesive. The tape and the adhesive holds the anode and backfill in place and prevents a weathering environment from damaging the backfill. The sacrificial anode and backfill may also be located on the concrete surface to form a profile that extends away from the concrete surface.

The sacrificial anode is a discrete sacrificial anode and anodes are preferably distributed across a concrete surface to distribute the protection current to the steel.

DETAILED DESCRIPTION OF THE PREFERRED EMBODIMENTS

This invention provides in one aspect the use of a sacrificial anode and a backfill and a tape and an adhesive to protect steel in concrete which use comprises placing the backfill in contact with the concrete and placing the sacrificial anode in contact with the backfill and covering the backfill and sacrificial anode with the tape wherein the tape extends over the adjacent concrete surfaces on opposite sides of the sacrificial anode and backfill and attaching the tape to the concrete surface with the adhesive.

Sacrificial anode assemblies have the advantage that they can provide galvanic protection to the steel and do not require the maintenance of a power supply. However sacrificial anode assemblies loose adhesion to the concrete surface. Possible reasons for this include the generation of corrosion product at the anode interface and the difference in thermal expansion and contraction properties between the anode metal and the concrete substrate. In the product based on U.S. Pat. No. 5,292,411 adhesion to the concrete surface was preferably provided through an adhesive gel that also acted as the activating backfill. However, even in this case adhesion problems were encountered. This was attributed to water affecting the ionically conductive adhesive. These anodes have been pinned to the concrete surface to maintain adhesion.

An alternative solution is to use a stronger adhesive. An example of a very strong adhesive that is also used to bond fibre reinforcement to concrete to increase the concrete tensile strength is an epoxy adhesive. Other polymers may also provide adequate adhesion. The surface of the concrete is preferably cleaned and primed for application of the adhesive. An example of a primer is a water repellent coating such as a silane that inhibits the collection of water in the concrete behind the adhesive. Strong adhesives will restrict ionic current flow because of the lack of water and will effectively be insulators. Thus they cannot be used to electrically connect the sacrificial metal element to the concrete. However the anode and backfill may be held in place by a covering that is glued to the concrete surface with the adhesive. An example of a covering is a 50 mm wide builders crack bridging (scrim) tape.

The anode is preferably in an elongated form, examples of which include a ribbon, a wire and a bar, and is connected to the concrete through a backfill. The covering is preferably a tape that is preferably a fibre tape with an open weave to allow the adhesive to penetrate the tape. The tape and adhesive attaches the anode and backfill to the concrete surface on opposite sides of the anode/backfill assembly. The tape is preferably coated with the adhesive to isolate the backfill from a weathering environment.

Part of the concrete surface is covered with the insulating adhesive and this reduces the area of active sacrificial anode on the concrete surface. This may reduce the current off the sacrificial anode. To overcome this problem, the sacrificial anode may be fitted with an impressed current connection to facilitate the delivery of a temporary impressed current treatment from the anode. An example of an impressed current connection is a titanium wire connected to the sacrificial anode (GB2426008). An impressed current connection is a connection that does not corrode when it is driven to positive potentials using a power supply.

A temporary impressed current treatment is preferred over a long term impressed current treatment as a power supply is only maintained for a short period. A temporary treatment may be used to restore steel passivity in the event that a risk of steel corrosion is detected. An example of this is given in GB2426008. A temporary treatment will generate hydroxide at the steel which promotes steel passive film formation. A temporary treatment will also draw chloride to the sacrificial anode to promote sacrificial anode activity. A temporary treatment has a foreseeable termination point and will preferably last less than 3 months and more preferably last less than 3 weeks. By comparison to the temporary impressed current treatment, the galvanic current treatment from the sacrificial anode is described as long term or permanent with a period measured in years and an applicator would normally leave the treatment running at the end of an application contract. Other known examples of treatments described as temporary and permanent are given in European Federation of Corrosion, Publication 24, (Electrochemical Rehabilitation Methods for Reinforced Concrete Structures—A state of the art report, ISBN 1-86125-082 7, 1998).

The sacrificial anode and backfill may be located in a groove formed in the concrete cover over the reinforcing steel. This increases the surface area of the anode that delivers current into the concrete and reduces the profile of the assembly that extends away from the concrete surface. An example of such a groove may be a slot or chase cut into the concrete surface. The groove is preferably covered with the tape and the adhesive to isolate the backfill from the external environment to prevent weathering of the weak backfill material. Thus the anode and backfill can be located close to the concrete surface as there is no need to cover the anode and backfill with a repair mortar.

This invention provides in another aspect the use of a sacrificial anode and a backfill and an insulating adhesive to protect steel in concrete which use comprises placing the backfill on the concrete and covering the backfill with the sacrificial anode wherein the sacrificial anode extends past the backfill on opposite sides of the backfill and attaching the sacrificial anode to the concrete surface with the insulating adhesive.

BRIEF DESCRIPTION OF THE DRAWINGS

This invention will now be further described with reference by way of example to the drawings in which.

EXAMPLES

Figure 1:
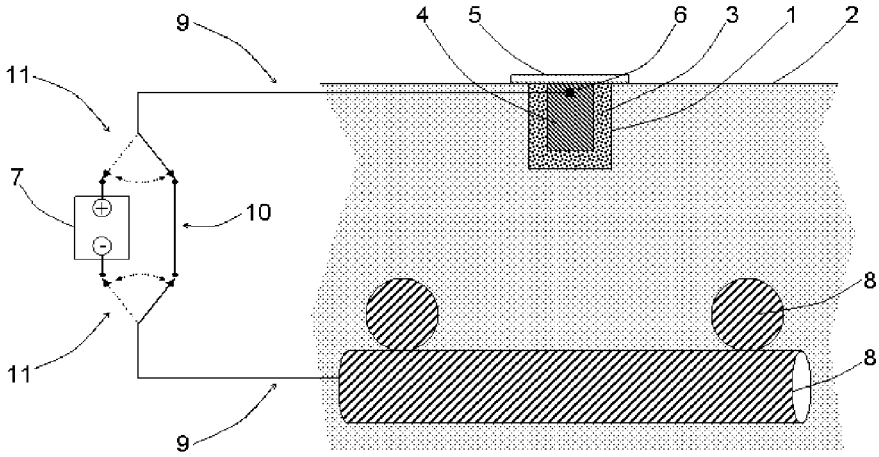
FIG. 1 shows an arrangement using a slot in a concrete surface and FIG. 2 shows an anode assembly located on a concrete surface and FIG. 3 shows another arrangement located on a concrete surface.

Referring to FIG. 1, slots [1] are cut into a concrete surface [2]. Only one slot is shown but slots will preferably be distributed over the anode surface to distribute the protection current to the steel. It is preferable to fill the slots with a backfill [3], an example of which is given in WO2007/039768 and then to insert the sacrificial anode [4] into the backfill. In this example the sacrificial anode is a bar with a rectangular section. The concrete surface adjacent to the slots is cleaned and a primer is applied. While the primer is still tacky, a tape [5] comprising a fibre with an open weave is located over the slot. The adhesive is then applied to the tape to glue the tape to the concrete surface and to isolate the backfill from the external environment.

The anode may be connected to a titanium wire [6] to form an impressed current connection. This is preferable if the anode is also to be used as an impressed current anode. The location of the titanium wire—anode connection is preferably on the edge of the anode closest to the concrete surface. The connection is preferably isolated from contact with the electrolyte in the environment.

The titanium wire may be connected to the positive terminal of a DC power supply [7] and the steel [8] may be connected to the negative terminal of the power supply through electrical connections [9]. Alternatively the anode may be directly connected [10] to the steel to deliver galvanic protection. A schematic switching arrangement [11] to switch between the galvanic and impressed current options is included in FIG. 1. Any sequential combination of impressed current and galvanic treatments is possible. However, if an impressed current treatment is used, it is preferably a temporary impressed current treatment as the power supply does not need to be maintained in the long term in this case and can be removed at the end of the treatment.

Figure 2:
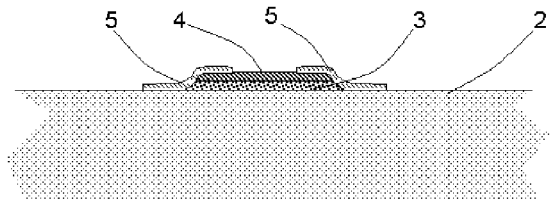

FIG. 2 shows a backfill [3] located on a concrete surface [2] and a sacrificial anode [4] located on the backfill. In this example a sacrificial anode ribbon is shown. The ribbon anode is attached to a tape [5] at least at opposite edges of the ribbon anode and the tape extends away from the ribbon anode. The tape may be attached to the ribbon anode in advance and the backfill may be located on the ribbon anode prior to placing the assembly on the concrete surface. After the assembly is located on the concrete surface, the tape is glued to the concrete surface with an adhesive. The steel and the connections between the anode and the steel are not shown.

Figure 3:
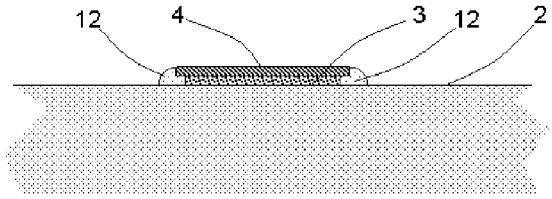

FIG. 3 shows a backfill [3] located on a concrete surface [2] and a ribbon anode [4] located on the backfill such that the edge of the anode extends away from the backfill on opposite sides of the backfill. The edge of the anode is then glued to the concrete surface using an adhesive [12].

The invention claimed is:

1. A method of protecting steel in concrete using a sacrificial anode and a backfill and a tape and an adhesive which method comprises forming a cavity in the concrete and placing the backfill and sacrificial anode at least in part in the cavity and covering the backfill and sacrificial anode with the tape and attaching the tape to surfaces of the concrete adjacent to and on opposite sides of the cavity with the adhesive wherein the sacrificial anode comprises a metal less noble than steel and the backfill is adapted to accommodate the products of sacrificial metal dissolution.

2. A method as claimed in claim 1 wherein the sacrificial anode is an elongated anode selected from a ribbon, a bar, a wire.

3. A method as claimed in claim 1 wherein the cavity formed in the concrete comprises one of a cut slot, a cut chase.

4. A method as claimed in of claim 1 wherein the tape is a fibre tape with an open weave.

5. A method as claimed in claim 1 wherein the surface of the concrete to which the adhesive is applied is treated with a water repellent primer.

6. A method as claimed in claim 1 wherein the sacrificial anode has an impressed current connection.

7. A method as claimed in claim 6 wherein the sacrificial anode is connected to a titanium wire.

8. A method as claimed in claim 1 wherein a temporary impressed current treatment is delivered from the sacrificial anode.

9. A method of protecting steel in concrete using a sacrificial anode and a backfill and an insulating adhesive which method comprises placing the backfill on the concrete and covering the backfill with the sacrificial anode and attaching the sacrificial anode to the concrete surface with the insulating adhesive that extends from the surface of the sacrificial anode to the concrete surface wherein the sacrificial anode comprises a metal less noble than steel and the backfill is adapted to accommodate the products of sacrificial metal dissolution.

10. A method as claimed in claim 9 wherein the sacrificial anode extends past the backfill on opposite sides of the backfill and the insulating adhesive attaches the sacrificial anode to the concrete surface on opposite sides of the backfill.

* * * * *